US006876335B2

(12) United States Patent
Woetzel

(10) Patent No.: US 6,876,335 B2
(45) Date of Patent: Apr. 5, 2005

(54) ARRANGEMENT FOR FEEDING A CENTRALLY FOCUSED REFLECTOR ANTENNA

(76) Inventor: Frank E. Woetzel, Petersburger Str. 73, Berlin (DE), D-10249

( * ) Notice: Subject to any disclaimer, the term of this patent is extended or adjusted under 35 U.S.C. 154(b) by 0 days.

(21) Appl. No.: 10/475,543

(22) PCT Filed: Apr. 19, 2002

(86) PCT No.: PCT/DE02/01511

§ 371 (c)(1),
(2), (4) Date: Oct. 20, 2003

(87) PCT Pub. No.: WO02/087018

PCT Pub. Date: Oct. 31, 2002

(65) Prior Publication Data

US 2004/0130498 A1 Jul. 8, 2004

(30) Foreign Application Priority Data

Apr. 21, 2001 (DE) ..... 201 07 294 U

(51) Int. Cl.[7] ..... H01Q 13/00
(52) U.S. Cl. ..... 343/775; 343/781 R; 343/785
(58) Field of Search ..... 343/775, 771, 343/772, 781 R, 785, 786, 755; 333/26, 137

(56) References Cited

U.S. PATENT DOCUMENTS 3,618,090 A * 11/1971 Garrison ..... 342/147
3,911,440 A * 10/1975 Mizusawa ..... 343/755
4,274,097 A * 6/1981 Krall et al. ..... 343/719
4,554,552 A * 11/1985 Alford et al. ..... 343/786
4,684,952 A 8/1987 Munson et al.
5,451,969 A 9/1995 Toth et al.
5,812,096 A 9/1998 Tilford
6,091,371 A 7/2000 Buer et al.
6,549,173 B1 * 4/2003 King et al. ..... 343/772

FOREIGN PATENT DOCUMENTS

| | | |
|---|---|---|
| DE | 4223138 | 6/1993 |
| EP | 0527569 | 2/1993 |
| GB | 2314688 | 1/1998 |
| WO | WO99/63624 | 12/1999 |

* cited by examiner

*Primary Examiner*—Tho Phan
(74) *Attorney, Agent, or Firm*—W. F. Fasse; W. G. Fasse

(57) ABSTRACT

An arrangement for feeding a centrally focused reflector antenna includes a waveguide (1), a dielectric field transformer (2) arranged on the waveguide (1) and a mounting platform (3) for a series of modules (8) which is embodied on one end of the waveguide (1). The waveguide (1) is provided with an arrangement for receiving the dielectric field transformer (2) which partially protrudes into the waveguide (1). Preferably, a dielectric support (9) may be provided in the vicinity of the dielectric field transformer (2). The middle of the support has a circular bore (12) whose diameter corresponds to the diameter of the dielectric field transformer (2). The centrally focused reflector antenna can be excited in the focal point thereof in a field-optimum broadband manner.

8 Claims, 4 Drawing Sheets

ARRANGEMENT FOR FEEDING A CENTRALLY FOCUSED REFLECTOR ANTENNA

FIELD OF THE INVENTION

The present invention relates to an arrangement for feeding a centrally focused reflector antenna.

BACKGROUND INFORMATION

The arrangement has particular application in the areas of communications technology in stationary, portable and mobile transceiver systems of high-frequency electromagnetic radiation sources, in particular of geostationary and orbiting satellite systems, in mobile ground and air sources as well as in point-to-point radio relay transmission or point-to-multipoint radio relay transmission of safety, radar and non-contacting sensor equipment.

Prior arrangements for feeding a centrally focused reflector antenna system have used either a corrugated horn or a flatly flared waveguide piece as a feed system located at the end of the waveguide. The feed system is disposed at the focal point, the phase center, of the reflector antenna and is intended to illuminate it in an optimum manner. Of particular significance is a largely uniform illumination of the reflector at uniform phase occupancy.

SUMMARY OF THE INVENTION

Prior arrangements for the purpose of feeding a reflector antenna system and its beam scanning have utilized a feed system at the focal point of the reflector antenna or a feed system mounted in the vicinity of the focal point, which consists of discrete radiating elements (ARRAY) or a combination of such an array fed by another system.

Due to the functionalities of the corrugated horn feed system or the flatly flared waveguide, known technical solutions for that purpose fail to achieve optimum field distribution in the reflector system and/or optimum illumination. Analogously, this also applies to feed systems designed to influence the antenna's radiation pattern, where especially in this case significant losses of gain and system quality occur or have to be accepted. This is equally true of suppressing undesired sidelobes.

As a result of design constraints, the necessary sealing of the waveguide system from environmental effects can be achieved only by using additional and expensive components which may possibly further degrade the functionality of the feed system. In addition, the prior feed systems cannot be combined with downstream modules, such as down converters, in a non-reactive manner. This means that in general additional work to provide for an optimum match between such a prior feed system and the downstream module, including the cost involved, will be required.

Therefore, it is an object of the present invention to provide a cost-effective arrangement for feeding centrally focused reflector antennas in a field-optimum broadband manner at their focal point, the phase center, while at the same time establishing a non-reactive connection to downstream modules and improving environmental sealing of the waveguide, and to ensure a proper match between the feed system and the respective reflector geometry (f/D ratio) so as to influence the design of the radiation pattern including the functionality of changing the field distribution at the waveguide end specifically with respect to the reflector system in such a way that no feedback into the waveguide and, therefore, into the downstream module will be caused.

In accordance with the invention, this object has been achieved in an arrangement for feeding a centrally focused reflector antenna comprising a waveguide and a dielectric support, characterized in that a dielectric field transformer is mounted on the waveguide and the dielectric support is mounted in front of the waveguide in the vicinity of the dielectric field transformer without being mechanically or electrically connected thereto, wherein the dielectric support includes a circular bore at the center thereof whose diameter corresponds to the diameter of the dielectric field transformer, the dielectric field transformer partly protrudes into the circular bore, and a mounting platform for downstream modules is provided at the end of the waveguide.

Preferred embodiments of the arrangement according to the invention are defined by the features of the dependent claims.

One particular advantage of the arrangement according to the invention is that it ensures that centrally focused reflector antennas will be fed in a field-optimum broadband manner at their focal points. No mechanically moved components are required as a result of the dielectric field transformer. The entire arrangement can be easily manufactured in a cost-effective manner with high mechanical precision, while it also exhibits high tolerance with respect to various environmental conditions such as temperature, air humidity and aggressive media.

In a preferred embodiment of the invention, mounting a dielectric support in the vicinity of the dielectric field transformer and mounting passive, easy-to-control radiator components on the dielectric support permits to change the broadband feed field of the field transformer while optimizing loss and field, without requiring mechanically displaced components and without having to mechanically connect the dielectric support to the field transformer.

BRIEF DESCRIPTION OF THE DRAWINGS

Other advantages will become apparent from the following description of the arrangement according to the invention taken in conjunction with the accompanying drawings, wherein.

DETAILED DESCRIPTION OF PREFERRED EXAMPLE EMBODIMENTS AND OF THE BEST MODE OF THE INVENTION

Figure 1:
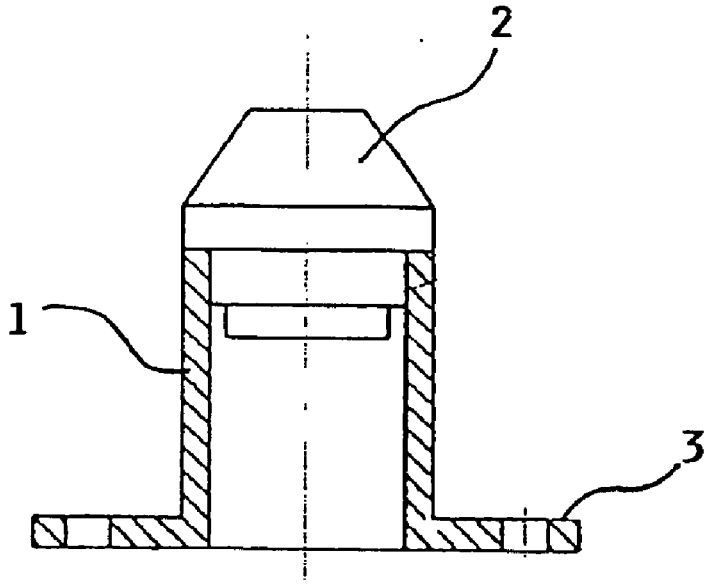
FIG. 1 shows a section of an arrangement according to the invention.
Figure 2:
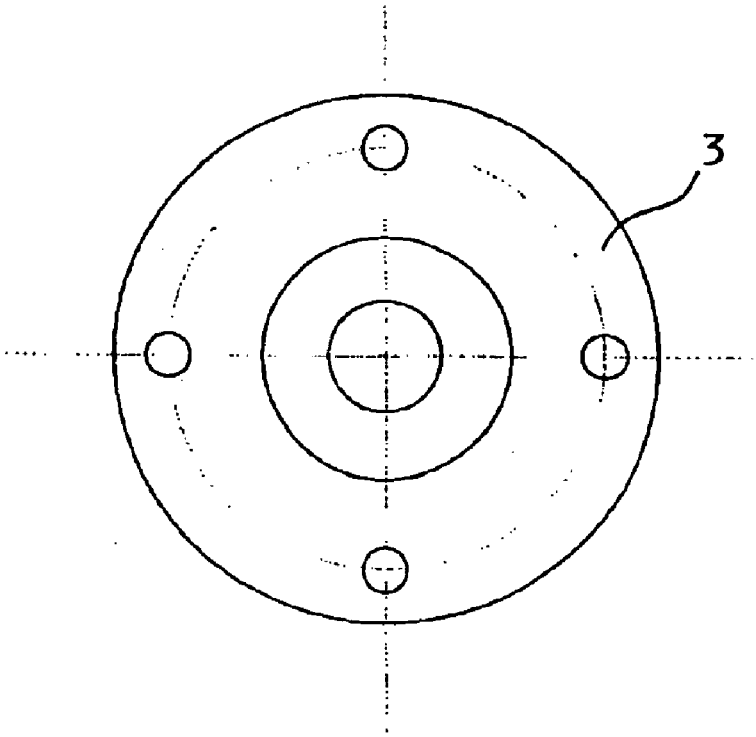
FIG. 2 is a plan view of the arrangement shown in FIG. 1.

As shown in FIG. 1, the arrangement according to the invention comprises a blunt ended waveguide 1 closed on one side by a dielectric field transformer 2 which partly protrudes into the waveguide 2 and whose geometry corresponds, or is matched to, the reflector system used. At its other end, the waveguide 1 comprises a mounting platform 3 for downstream modules 8. The dielectric field transformer 2 affects the E components of the alternating electromagnetic field in the direction of propagation such that the original wave field will be deformed at the other end of the waveguide 1 so as to obtain a uniform, especially circular expansion of the resulting radiation field of the waveguide 1 and a selectable power distribution on the reflector. This causes a drastic increase in the efficiency of the arrangement as a whole.

In a preferred embodiment of the arrangement according to the invention, the downstream module 8 is not connected by any rigid mechanical means to the waveguide 1 and the mounting platform 3; instead, these are mounted in a rotatable and mechanically fixable manner about the axis of symmetry of the reflector 6. This provides the particular benefit that all functionalities of the system are maintained without changing the position of the entire antenna arrangement, particularly of the reflector 6, while any rotations of polarization with respect to the orthogonal alignment of the H/E vector to the normal earth plane—in this case especially the so-called skew angle—can be compensated for by rotating the downstream module 8.

Moreover, the dielectric field transformer 2 has the advantage that for a region of high bandwidth the influence on the field is nearly uniform, while at the same time a transformation from the waveguide wave mode to the free-space mode is realized, whereby the arrangement of dielectric field transformer 2/waveguide 1 can be connected to a downstream system without any feedback.

Figure 3:
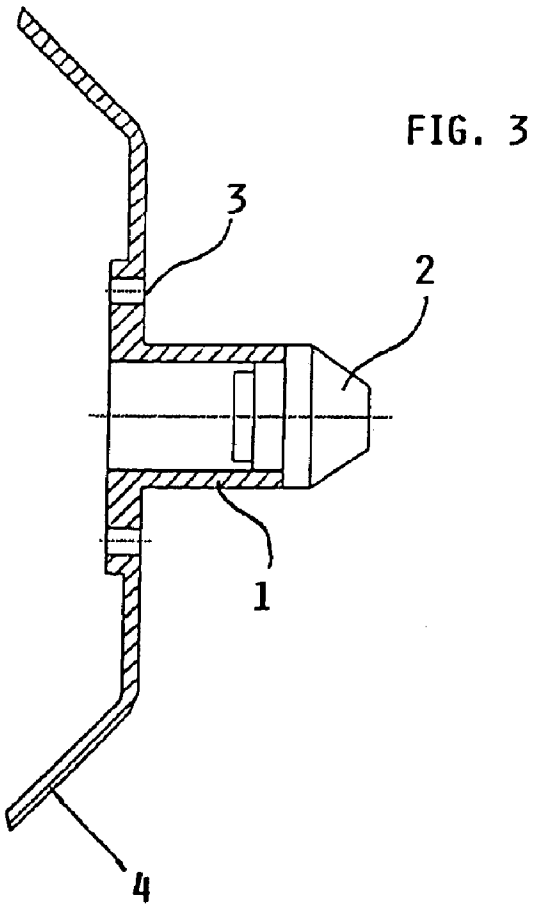
FIG. 3 shows a section of an arrangement according to the invention including a mount for mounting a circular reflector.

FIG. 3 depicts an arrangement according to the invention including the mount 4, shown folded here, for receiving a reflector, the dielectric field transformer 2 and the mounting platform 3 provided for downstream modules.

Figure 4:
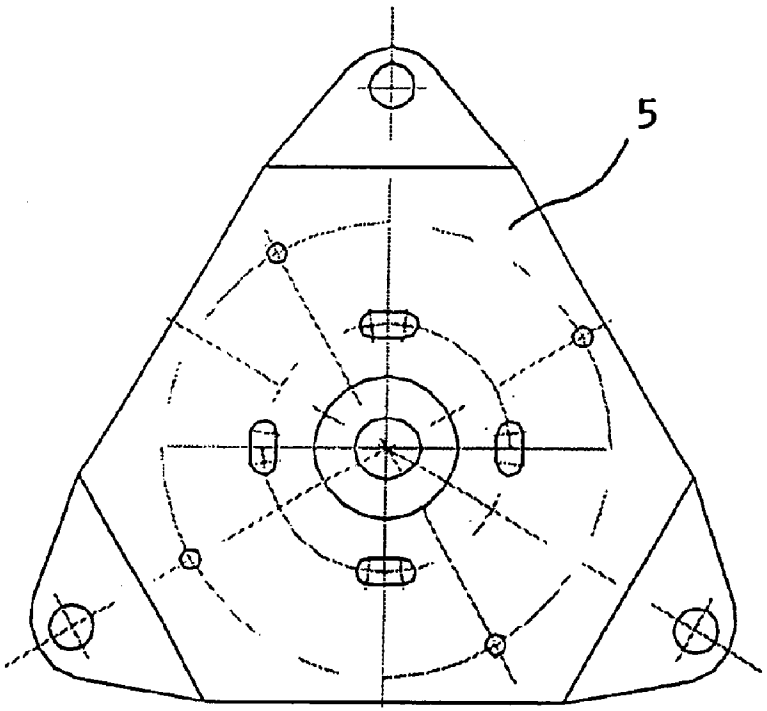
FIG. 4 is a rear view of the arrangement according to the invention shown in FIG. 3.

FIG. 4 is a rear view of this arrangement, in which the mounting platform 3 is formed as an equilateral triangle area 5 in order to minimize shadowing in the reflector.

Figure 5:
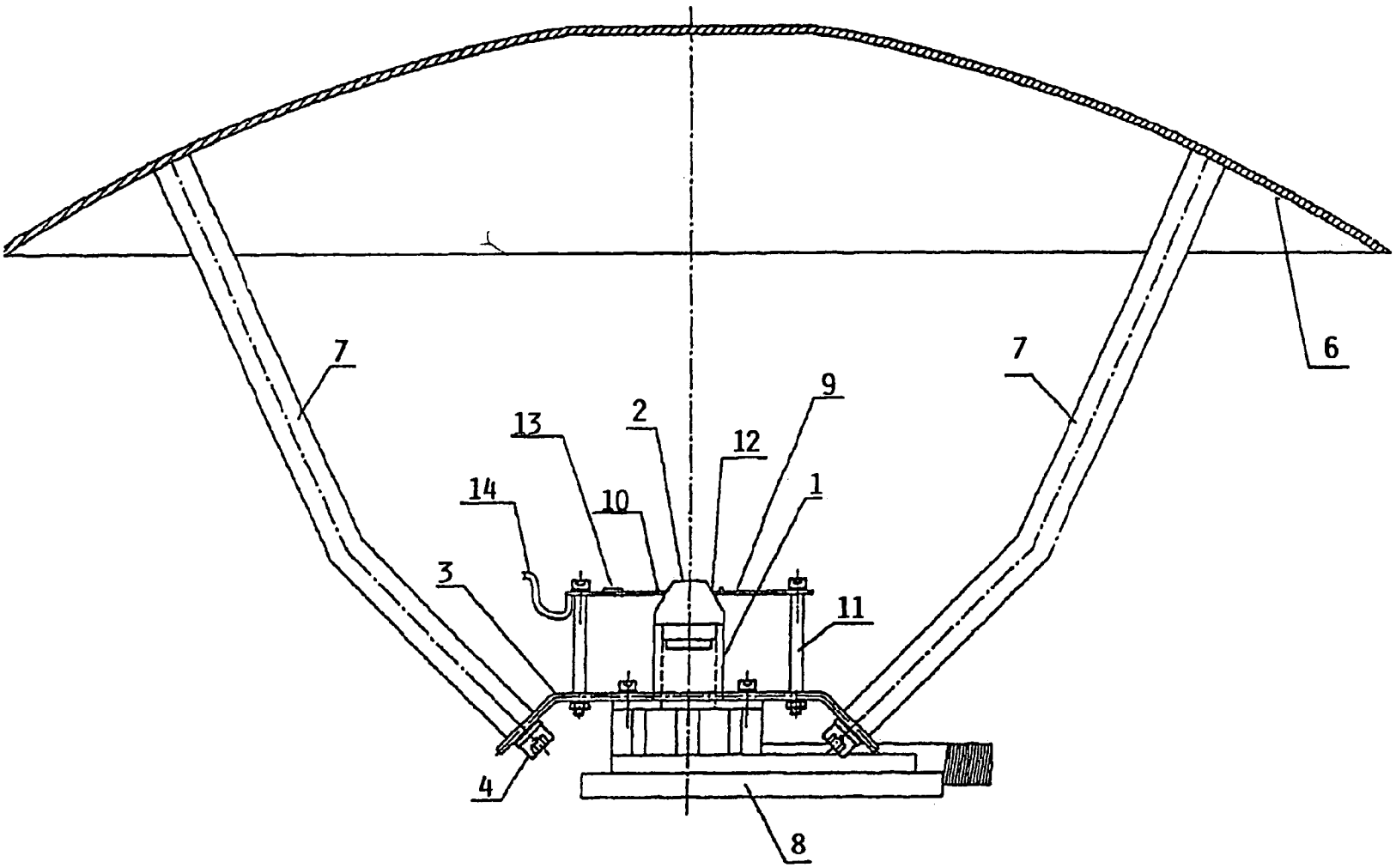
FIG. 5 shows a section of an arrangement according to the invention including the mounted reflector.

In FIG. 5, the arrangement according to the invention is shown with a mounted reflector. The subreflector having a circular aperture 6 is mounted to the mounts 4 by means of the struts 7. In the present embodiment, the downstream modules 8 are bolted to the mounting platform 3. The arrangement according to the invention is positioned at the axis of rotation of the reflector 6 and with the dielectric field transformer 2 at the height of the focal point of the reflector 6.

As shown in FIG. 5, bolted spacers 11 are used to mount a support plate 9 in the vicinity of the dielectric field transformer 2. The dielectric support plate 9 includes a bore 12 at the location of the field transformer 2 having a diameter suitable for the field transformer 2, and is disposed in a plane-parallel fashion to the mounting platform 3 without having any direct mechanical or electrical connection to the dielectric field transformer 2.

The dielectric support plate 9, on which the passive radiator components and circuit elements 10 are mounted, has the effect that the source field from the dielectric field transformer 2 will only be slightly influenced depending on the openings in the dielectric support plate 9; as a consequence, the penetrating field and, therefore, the entire antenna arrangement will suffer only small attenuation so that an extremely high efficiency continues to be available. At the same time, the source field from the dielectric field transformer 2 can be influenced such that the resulting radiation pattern of the antenna may be varied within the limits desired for the application. Another benefit of this embodiment of the arrangement is that simple mechanical mounting means for different antenna layouts permit to achieve both optimum illumination and, hence, high efficiency of the entire antenna arrangement, while at the same time the radiation pattern can be influenced. A specific result is that the necessary reflector area 6 may be significantly smaller compared to conventional beam scanning systems.

Figure 6:
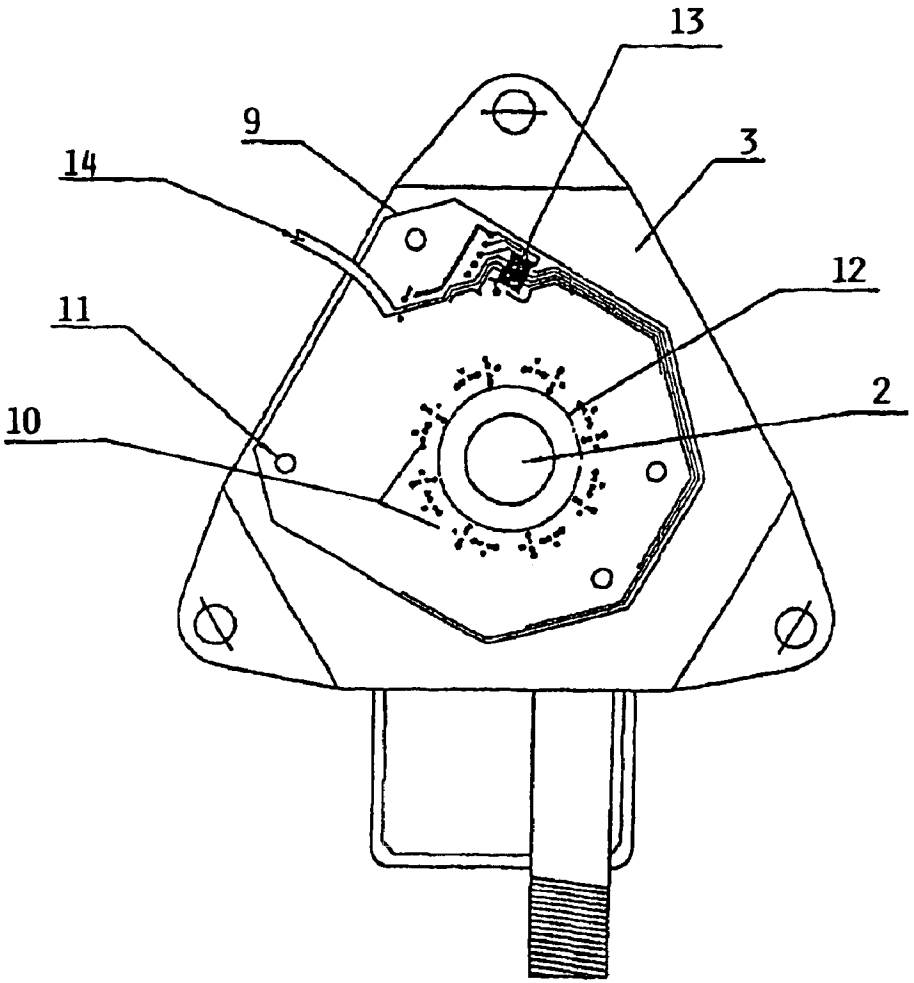
FIG. 6 is a plan view of the dielectric support.

FIG. 6 shows a plan view of the dielectric support 9. It is secured to the mounting platform 3 using the spacers 11 which can be bolted. The dielectric support 9 includes a circular bore 12 at its center whose diameter corresponds to the dielectric field transformer 2. Around the bore 12 of the dielectric support 9, parasitic (passive) radiating elements with circuit components 10 are arranged. In FIG. 6, these have an exemplary uniform distribution in an angle of 90° each, where each element consists of a pair of radiators positioned orthogonally to each other. Further, on the dielectric support 9, a control block 13 including standard components is mounted, which controls the circuit components. The control block is connected to other downstream modules via a cable 14.

LIST OF REFERENCE NUMBERS

1 waveguide
2 dielectric field transformer
3 mounting platform
4 mount
5 triangle area
6 reflector
7 struts
8 downstream module
9 dielectric support plate
10 radiator components/circuit elements
11 spacers
12 bore
13 control block
14 cable

What is claimed is:

1. An arrangement for feeding a centrally focused reflector antenna comprising a waveguide (1) and a dielectric support (9), characterized in that a dielectric field transformer (2) is mounted on said waveguide (1) and said dielectric support (9) is mounted in front of said waveguide (1) in the vicinity of said dielectric field transformer (2) without being mechanically or electrically connected thereto, wherein said dielectric support (9) includes a circular bore (12) at the center thereof whose diameter corresponds to the diameter of said dielectric field transformer (2), said dielectric field transformer (2) partly protrudes into said circular bore (12), and a mounting platform (3) for downstream modules (8) is provided at the end of said waveguide (1).

2. The arrangement of claim 1, further comprising a reflector, characterized in that the geometry of said dielectric field transformer (2) is matched to the reflector.

3. The arrangement of claim 1, characterized in that all components of said arrangement other than said dielectric field transformer (2) and said dielectric support (9) are made of metal, and the interior of said waveguide (1) has a surface roughness of less than 0.5 $\mu$m.

4. The arrangement of claim 3, wherein said components made of said metal are made in one piece.

5. The arrangement of claim 1, further comprising a reflector, characterized in that said mounting platform (3) includes mounts (4) to which said reflector (6) is mounted by means of struts (7), and said downstream module (8) is mounted in a rotatable and fixable manner about the axis of symmetry of said reflector (6).

6. The arrangement of claim 1, characterized in that said dielectric support is connected to said mounting platform (3) by means of bolted spacers (11) of metal or dielectric material, and is arranged plane-parallel to said mounting platform.

7. The arrangement of claim 1, characterized in that parasitic radiator elements with circuit components (10) are arranged on said dielectric support (9) individually or in orthogonally aligned pairs having a planar or three-dimensional geometry in an edge region of a beam path around said bore (12).

8. The arrangement of claim 7, wherein said radiator elements are passive radiator elements feedable by radiation coupling.

* * * * *